United States Patent [19]

DiProspero

[11] 4,222,142

[45] Sep. 16, 1980

[54] GUN CLEANING DEVICE

[76] Inventor: Peter DiProspero, 814 W. 25th St., Erie, Pa. 16502

[21] Appl. No.: 3,359

[22] Filed: Jan. 15, 1979

[51] Int. Cl.[2] ..... F41C 31/00

[52] U.S. Cl. ..... 15/104.165; 15/104.18; 15/114

[58] Field of Search ..... 15/104.165, 104.18, 15/114, 104.2

[56] References Cited

U.S. PATENT DOCUMENTS

| | | | |
|---|---|---|---|
| 358,304 | 2/1887 | Simpson | 15/104.165 X |
| 753,189 | 2/1904 | Buckelew et al. | 15/104.18 |

*Primary Examiner*—Edward L. Roberts

*Attorney, Agent, or Firm*—Charles L. Lovercheck

[57] ABSTRACT

A tip for a cleaning rod is disclosed. The tip has a threaded end to be received in the threaded end of a cleaning rod, and a rag receiving loop on the end opposite the threaded end. Bristles are supported on the body of the tip between the threaded end and the slotted end, and a sleeve slides over the bristles from a position adjacent the slotted end holding the ends of the bristles to the tip. The sleeve can be slid to the end remote from the tip over the roots of the bristles allowing the bristles to diverge outwardly to thereby give the user the choice of cleaning the gun with or without the wire bristles.

1 Claim, 1 Drawing Figure

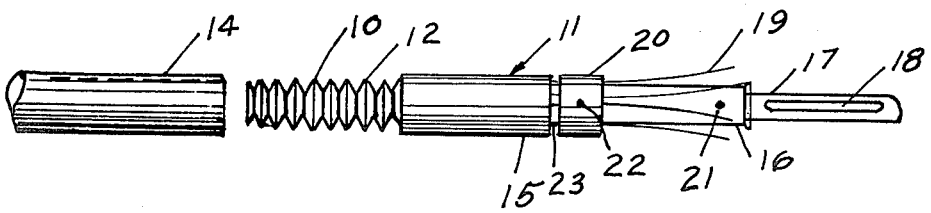
14
10
12
11
20
19
17
18
15
23
22
21
16

GUN CLEANING DEVICE

GENERAL DESCRIPTION OF THE INVENTION

The invention disclosed herein made up of a tip of the type commonly used for cleaning rods for guns. The tip has a threaded end that can screw into a cleaning rod and a slotted end that can receive a cloth patch that can be oiled or treated with gun barrel solvent to dissolve undesirable deposits in the gun barrel. The tip has an enlarged size part to which bristles are attached and a sleeve slides over the bristles so that it will hold the bristles to the tip when they are not to be used, or the sleeve can be slid to the other end so that they will allow the bristles to move outwardly.

OBJECTS OF THE INVENTION

It is an object of the invention to provide an improved cleaning rod.

Another object of the invention is to provide a combination cleaning rod tip with a brush and rag holder.

Another object of the invention is to provide a cleaning rod that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWING

The drawing shows a cleaning rod tip according to the invention.

DETAILED DESCRIPTION OF THE DRAWING

Now, with more particular reference to the drawing, the cleaning rod tip is indicated generally at 10 and it has a body 11 having a reduced size threaded end 12, the body has an enlarged size intermediate part attached to the threaded end and a second end 17 having a rag receiving slot 18 remote from the threaded end. The body has an enlarged part 15 connected to the tip 17 by a reduced size part 16 and the bristles 19 are connected to the large part 15 and extend toward the slotted end

17. The slotted end 17 has a slot 18 in it which a suitable rag patch can be supported. A sleeve 20 is slidably supported on the reduced size part and the sleeve has an internal dimple that will receive the ends 21 and 22, whereby it may be held in position adjacent in large size part overlying the roots of the bristles 19 or it can be slid to the right where it will hold the bristle ends in position to the reduced size portion of the body and retained by detent 21.

In operation the tip threaded end 12 will be screwed into the threaded end of the rod 14 by the operator grasping the large size part 15 with his fingers. Then he may put a rag in the slot 18 for a suitable oil or cleaning solvent for the rag to clean the gun. He has the option of sliding the sleeve toward the slotted tip 17 so that it holds the bristles 19 closely to the reduced size part 16 of the tip. He can slide it to the position shown so that it will override the roots 23 of the bristles 19, thereby holding the bristles to the tip.

The embodiments of the invention in which an exclusive property or privilege is claimed are defined as follows:

1. A gun cleaning tip (10) comprising a body (11) having a threaded end (12), said threaded end (12) being adapted to be received in the threaded end of a cleaning rod (14), a second end (17) having a slot (18) therein, said body (11) having an enlarged part (15) integrally connected to said threaded end (12) and reduced size part (16) integrally connected to said enlarged part (15) and to said second end (17), bristles having one end connected to said enlarged part (15) and terminating adjacent said second end, a sleeve slidably received on said reduced size part and disposed around said bristles and slidable from a position adjacent said enlarged part (15) to a position adjacent said second end (17) and detent means (22) on said sleeve adapted to cooperate with detent means (21) on said reduced size part holding said sleeve selectively in a position adjacent said second end (17) to a position adjacent said enlarged part (15) whereby the ends (19) of said bristles are selectively held to said reduced size part so the user can selectively provide a cloth patch in said slot for cleaning the gun or can slide said sleeve to a position to allow said bristles to fan outward for cleaning said gun with said bristles.

* * * * *